United States Patent [19]

Lohrberg et al.

[11] 4,035,279

[45] July 12, 1977

[54] ELECTROLYTIC CELL

[75] Inventors: Karl Lohrberg, Heusenstamm; Jürgen Müller, Karben, both of Germany

[73] Assignee: Metallgesellschaft Aktiengesellschaft, Frankfurt am Main, Germany

[21] Appl. No.: 729,934

[22] Filed: Oct. 6, 1976

[30] Foreign Application Priority Data

Nov. 21, 1975 Germany ..... 2552286

[51] Int. Cl.[2] ..... C25B 1/26; C25B 9/00

[52] U.S. Cl. ..... 204/256; 204/250; 204/251; 204/252; 204/258; 204/266; 204/270; 204/278

[58] Field of Search ..... 204/250, 251, 252, 256, 204/266, 270, 278, 258

[56] References Cited

U.S. PATENT DOCUMENTS

| | | | |
|---|---|---|---|
| 1,255,096 | 1/1918 | Jaubert | 204/278 |
| 1,548,362 | 8/1925 | Holmboe | 204/258 |
| 2,695,874 | 11/1954 | Zdansky | 204/258 |
| 3,930,151 | 12/1975 | Shibata et al. | 204/258 |
| 3,972,794 | 8/1976 | Lamm | 204/266 |

*Primary Examiner*—Arthur C. Prescott
*Attorney, Agent, or Firm*—Burgess, Dinklage & Sprung

[57] ABSTRACT

An electrolytic cell for carrying out processes during which gas is evolved is disclosed. The cell includes at least one hoodlike cover positioned above one or more electrodes and having an outlet opening below the electrolyte surface for the gas-electrolyte suspension and an elecrolyte-recycling space positioned outside the projection of the cover. The recycling space is free from gas-producing electrodes and is spaced a sufficient distance from the outlet opening that the backflow of gas is precluded.

6 Claims, 7 Drawing Figures

ELECTROLYTIC CELL

BACKGROUND

This invention relates to an electrolytic cell for processes in which gas is evolved.

It is known that in the electrolysis of alkali metal chloride the electrode voltage at the gas-producing electrodes exceeds the voltage which corresponds to the thermodynamic equilibrium conditions. This phenomenon accounts for part of the overvoltage and is due to the fact that the gas bubbles formed during the electrolysis cover a part of the electrode surface and block said part of the surface for a flow of current. For this reason, a correspondingly higher current flows through adjacent electrode portions, when the total current is given. This partial increase in current density results necessarily in a voltage rise in this area and this voltage rise is virtually quantitatively transformed into heat and causes a temperature rise of the electrode surface. Because the gas cushion on the electrode surface opposes a rapid heat exchange with the electrolyte, the dissipation of said heat is relatively poor. The eventually resulting temperatures in infinitesimal areas of the electrode surfaces are far in excess of 100° C in commercial electrolytic processes and are responsible, inter alia, for corrosion phenomena on the electrodes.

Numerous proposals have been made to reduce the economically undesirable overvoltage and to restrict the attack of the electrode surface. For instance, the anode has been provided with a multiplicity of cylindrical holes or slots, which serve to discharge as quickly as possible the chlorine gas that has been evolved (Published German Applications 1,667,812; 1,792,183; British Pat. No. 1,229,402). Gas flow areas on an order of 15 – 35% of the total area of the anode are usual in such cases. Larger gas flow areas are avoided because they would result in an excessively high effective current density and activation overvoltage. The same purpose is served by numerous metal anode structures which have been proposed and consist, e.g., of expanded metal, slotted plates, or mesh structures.

Where the known proposals are adopted, the gas rises to the surface of the electrolyte on the shortest possible path. The potential energy which is contained in the gas owing to the hydrostatic processure of the electrolyte is randomly destroyed in this case or, more properly speaking, random turbulence is produced in the electrolyte. Dispersed gas bubbles are inevitably returned with the brine which flows into the space between the electrodes.

A further development relating to/the design of the flow passages for gas evolved during the electrolysis has been described in German Utility Modely 7,207,894. In accordance therewith, the flow passages are enlarged at least close to the surface of the electrode and toward said surface. Specifically, Venturi-like passages are provided. While this proposal affords some advantages, it cannot entirely avoid a flow of gas from the outlet of a flow passage into the suction range of the liquid which flows into the space between the electrodes so that said gas is entrained by the liquid.

A certain mode of operating mercury electrolytic cells is known, which involves anodes having groove-like recesses on the side facing the mercury and in which the arrangement of the anodes and/or the groovelike recesses is so selected that spaced apart areas are disposed between the anodes and serve for the outflow of chlorine from the space between the electrodes and for the inflow of brine into said space (U.S. Pat. No. 3,951,767). Partitions may be arranged between adjacent anodes having uniform groove-like recesses. Alternatively, anodes may be inserted in which the bottoms of the groovelike recesses of adjacent anodes are inclined in opposite directions from the horizontal.

While the mode of operation previously described has proved satisfactory and low cell voltages which are expected to be maintained over months of operation, a disadvantage arises which resides in that the mode of operation can be used virtually only in new installations on in existing plants which — for any reason whatever — are provided with new anodes. As a rule, there will be no adaptation or change of installations which inherently do/not require a shutdown. In addition, anodes with inclined groovelike recesses are somewhat difficult to manufacture.

SUMMARY

This invention eliminates prior disadvantages, particularly those mentioned above, and provides an electrolytic cell which can be used not only in new installations but also in new anodes in existing, operative electrolytic cells during a very short shutdown and usually without a considerable change.

This is accomplished by providing an electrolytic cell with at least one hoodlike cover which is positioned above one or more electrodes and has, below the electrolyte surface, an outlet opening for the gas-electrolyte suspension, and an electrolyte-recycling space positioned outside the projection of the cover. The recycling space is free from gas-producing electrodes and is spaced such a large distance from the outlet opening that a backflow of gas is precluded.

DESCRIPTION

The hoodlike cover must be fully immersed into the electrolyte and ensures a directed flow of the gas-electrolyte suspension. In that case there will be an intense backflow of electrolyte into the space between the electrodes through the backflow space or spaces, which is or are sufficiently spaced from the outlet opening. A return of any gas bubbles is virtually precluded.

The cell according to the invention may be provided with vertical or horizontal electrodes. It may be used as a diaphragm or mercury cell for the electrolysis of alkali metal chlorides, or may be used for the electrolytic decomposition of water, the electrolytic recovery of chlorate or peroxydisulfuric acid and the electrolytic recovery of metal. The electrodes may consist of the materials which are known for this purpose, such as iron and nickel for the decomposition of water, iron and activated titanium for the production of chlorate, lead and platinum for the production of peroxydisulfuric acid, and graphite or activated metal, such as titanium for the electrolysis of alkali metal chlorides.

The hoodlike cover may be made from any desired material which is stable under the conditions of the electrolysis. Materials which ar particularly suitable for the electrolysis of alkali metal chloride are, e.g., titanium, hard polyvinyl chloride, glass or glass fiber-reinforced polyester. Nickel, e.g., is also suitable for the decomposition of water.

According to a preferred feature of the invention the top of the hoodlike cover is upwardly inclined toward the outlet opening for the gas-electrolyte suspension.

Depending on the location of the outlet opening, the hoodlike cover may have the shape of a single-pitched roof or of two adjacent single-pitched roofs which rise toward each other. The outlet opening may be formed in the first case by a missing front wall and in the second case by a gap left between the two roofs which rise toward each other. The roofs should have an inclination of about 1°–20°.

The electrolytic cell according to the invention may be provided with the hoodlike cover installed into existing electrolytic cells. In electrolytic cells having vertical electrodes, the hoodlike cover is secured in a suitable manner to the outer gas-producing electrodes by screws or welded joints.

According to a preferred feature of the invention, an electrolytic cell comprises virtually horizontal anodes which are provided with flow passages, and a hoodlike cover which closes at least one upper edge portion and preferably at least three upper edge portions of the anode. In this case the covering may be reliably mounted, e.g., by section members provided near the lower edge portion or by drawn-in or impressed recesses, which ensure a reliable support. Suitable recesses in the top of the cover must be provided to accomodate the holders or stems of the electrodes.

Another preferred feature of the invention is particularly applicable in conjunction with activated metal anodes and resides in that the anode and the hoodlike cover of the electrolytic cell form a structural unit. The elements are connected, e.g., by screws or welded joints. If the metal anode consists of expanded metal, which is usually secured to a frame, the hoodlike cover may also be used to carry supporting bars.

If horizontal graphite anodes are used in the electrolytic cell, it will be desirable to provide the anode with groovelike recesses on the underside, i.e., in a cell for the electrolysis of alkali metal chloride with a flowing mercury cathode on the side which faces the mercury cathode. To discharge the resulting chlorine gas as quickly as possible through the gas flow opening in the anodes and to admit the brine to the gap between the electrodes, it will be particularly desirable in conjunction with hoodlike cover having a rising top to provide groovelike recesses which extend approximately at right angles to the direction in which the top is inclined.

In electrolytic cells having a large number of horizontal anodes, different directions of flow and different flow conditions may be provided for by a specific arrangement of the hoodlike cover. Adjacent to anodes spaced apart, e.g., in the longitudinal direction of the cell, the gas-electrolyte suspension may be caused to flow in the same direction or in opposite directions under the hoodlike cover. If the gas-electrolyte suspensions flow in the same direction, anode-separating partitions are usually provided between the anodes to ensure that rising gas bubbles will not be sucked by the electrolyte which flows into the adjacent space between the electrodes. Separating partitions will not be required if the gas-electrolyte suspensions flow in opposite directions. In that case, there will be a common gas-electrolyte outlet region for two adjacent anodes and the points where the electrolyte is admitted will be offset by approximately one anode length for the two anodes.

To provide a sufficiently large area for the flow of the electrolyte into the space or spaces between the electrodes in electrolytic cells having horizontal anodes, the distance between two adjacent anodes in the longitudinal direction of the cell should be about 5–15% of the anode length.

Independently of the nature and position of the electrode, the essential advantages afforded by the invention reside in a good recirculation of the electrolyte, a good cooling of the electrode, a large supply of electrolyte, a low cell voltage, and a very good discharge of gas. Additional advantages, which are specific to the anodes, reside in conjunction with graphite anodes in that the consumption and consequently the carbon dioxide content of the evolved gas, particularly in the chlorine gas, is much decreased and that in conjunction with activated metal anodes the life of the noble metal oxide layer and consequently the period between reactivating treatments is much decreased.

The invention will be explained more fully and by way of example with reference to the drawings and the example.

In the drawing, electrolytic cells according to the invention are shown in detail views.

Figure 1:
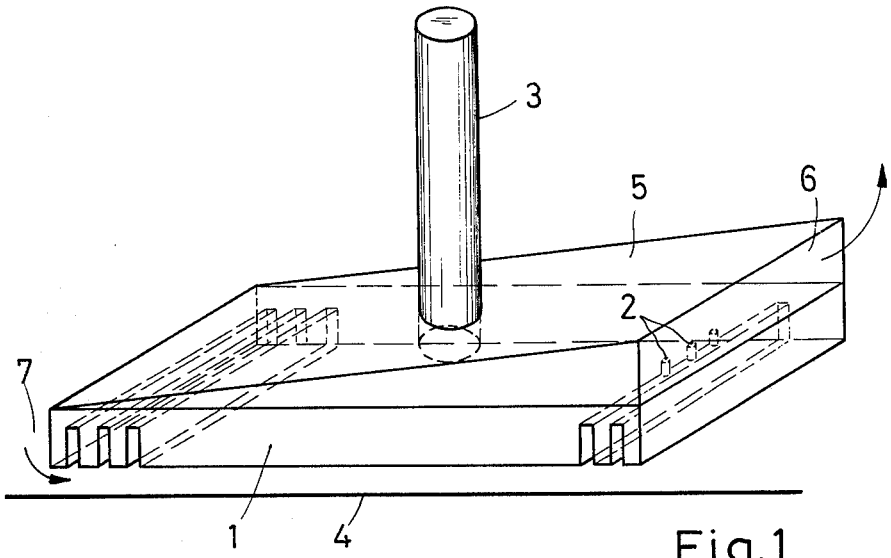
FIGS. 1 and 2 are perspective views showing horizontal anodes provided with hoodlike covers.
Figure 2:
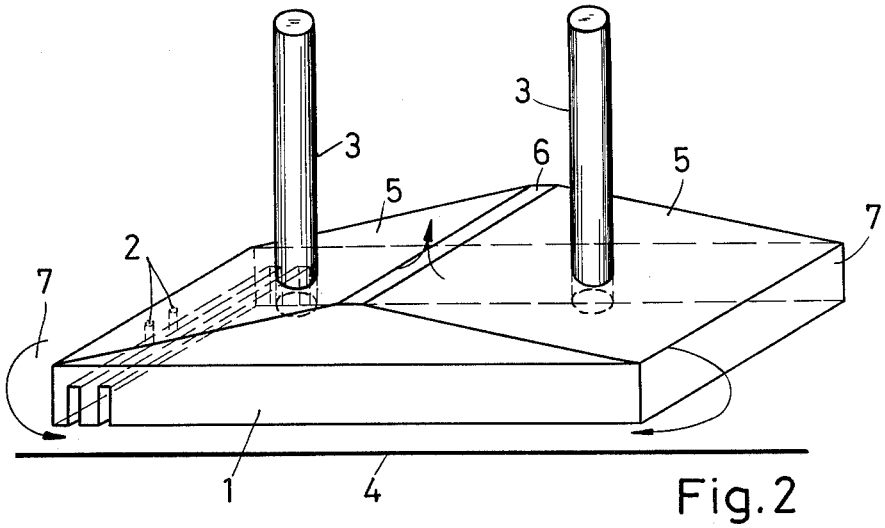

FIGS. 1 and 2 relate to the electrolysis of alkali metal chloride by means of a flowing mercury cathode. Horizontal graphite anodes 1 have flow passages 2 and anode stems 3. The mercury cathode is designated 4. Hoodlike covers 5 having the shape of a roof are provided on the upper side of the anodes 1. FIG. 1 shows a cover having a top which rises in one direction and FIG. 2 a cover which has a top which rises in opposite directions to the center. In dependence upon the different inclinations, the brine-chlorine foam is discharged in FIG. 1 through the opening 6 on the right and in FIG. 2 through the opening 6 at the center. Through the backflow spaces 7 which are opposite to the outlet openings 6, brine enters the space between the anodes 1 and and cathodes 4.

Figure 3:
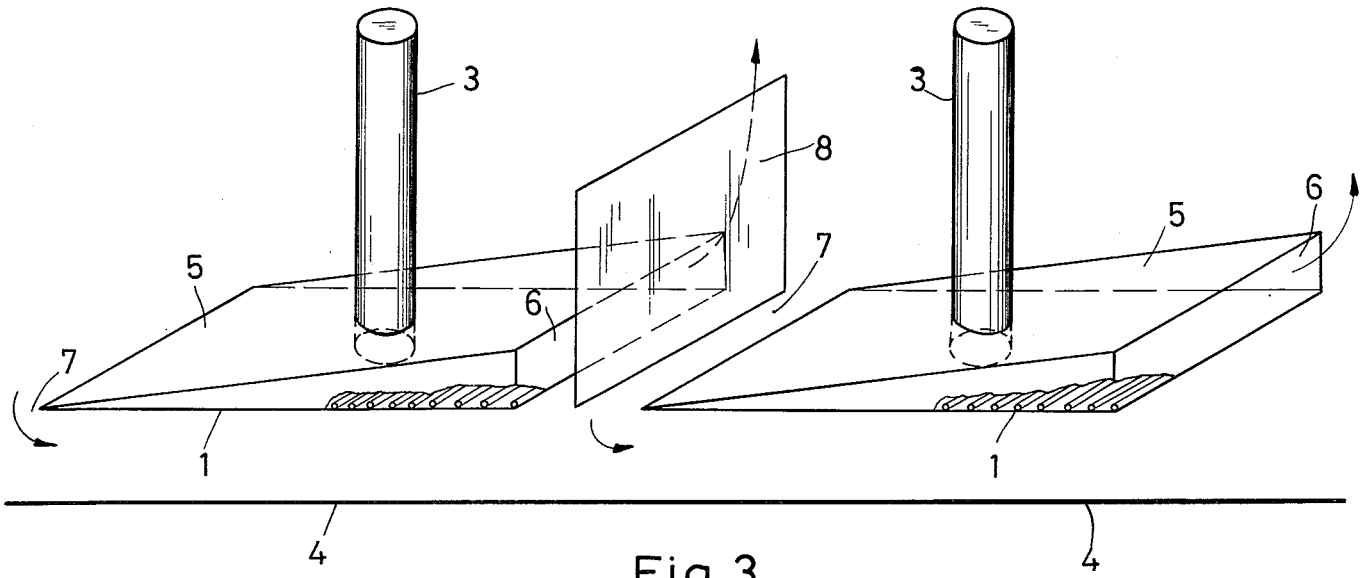
FIGS. 3 and 4 are perspective views showing the arrangement of the hoodlike coverings for adjacent anodes spaced apart in the longitudinal direction of the electrolytic cell.

FIG. 3 relates also to the electrolysis of alkali metal chloride with flowing mercury cathodes and shows hoodlike cover 5, also in the shape of a pitched roof, which rise all in the same direction. The anodes 1 consist of titanium metal which is activated with noble metal oxide and are shown only in a cut-away portion. Because the tops of the hoodlike covers 5 rise all in the same direction, adjacent outlet openings 6 for the chlorine-brine suspension spaced one anode length apart and so are the spaces 7 through which the brine is fed. A partition 8 prevents a return of chlorine gas bubbles into the backflow space 7 associated with the adjacent anode.

Figure 4:
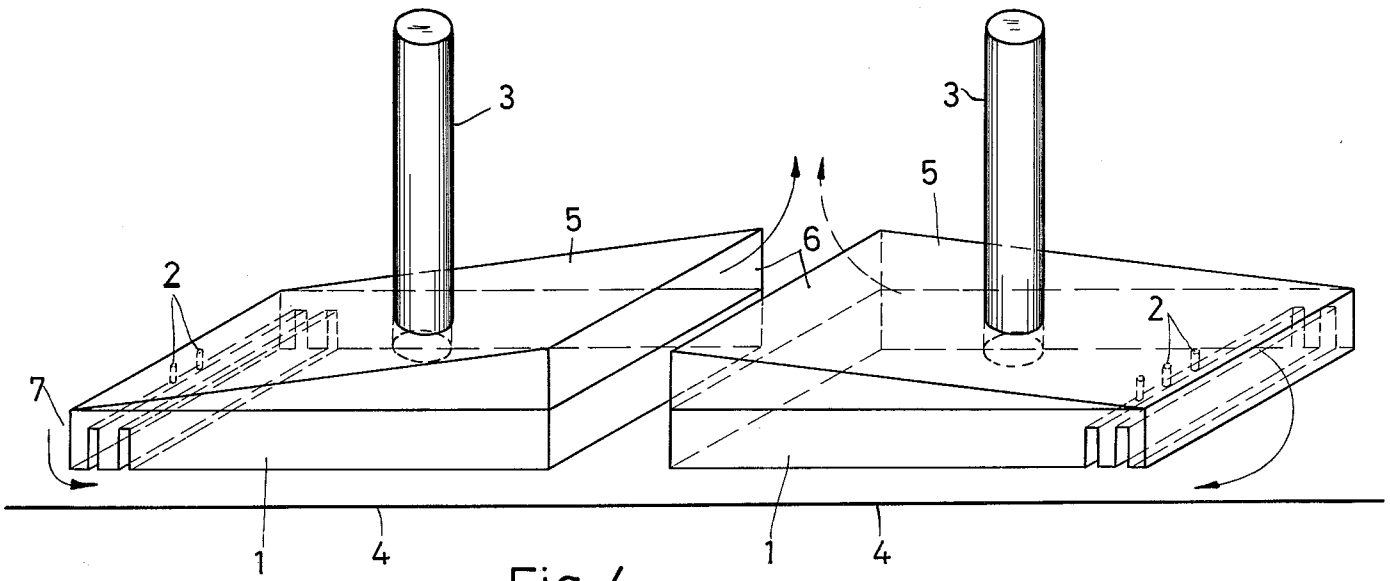

FIG. 4 shows the use of the invention with graphite anodes. The hoodlike covers 5 for adjacent anodes 1 rise in opposite directions so that the chlorine-brine suspension discharged under both covers 5 enters a common discharge region. In this case the outlet regions for the chlorine brine suspension are arranged in alternation with brine-feeding regions and the regions of each of these sets are spaced about two anode lengths apart. A partitionist not required in this case.

Figure 5:
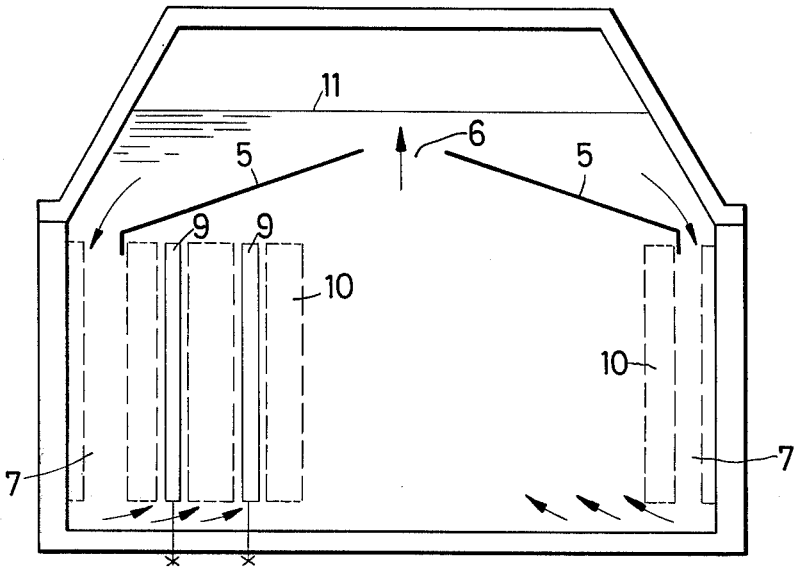
FIG. 5 is a vertical sectional view showing an electrolytic cell having vertical electrodes and FIGS. 6 and 7 are diagrammatic views showing means for directing the direction of flow.

FIG. 5 shows an electrolytic cell having vertical anodes 9 and vertical cathodes 10. The gas-producing electrodes are provided with a hoodlike cover 5. The gas-electrolyte suspension formed by the electrolysis flows out through the outlet opening 6, which is disposed under the electrolyte surface 11. The backflow space 7 is disposed outside of the projection of the cover 5.

Figure 6:
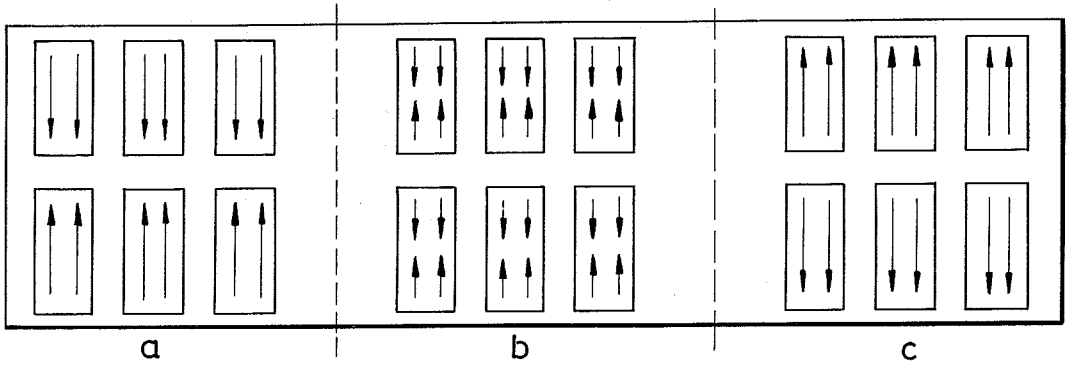
Figure 7:
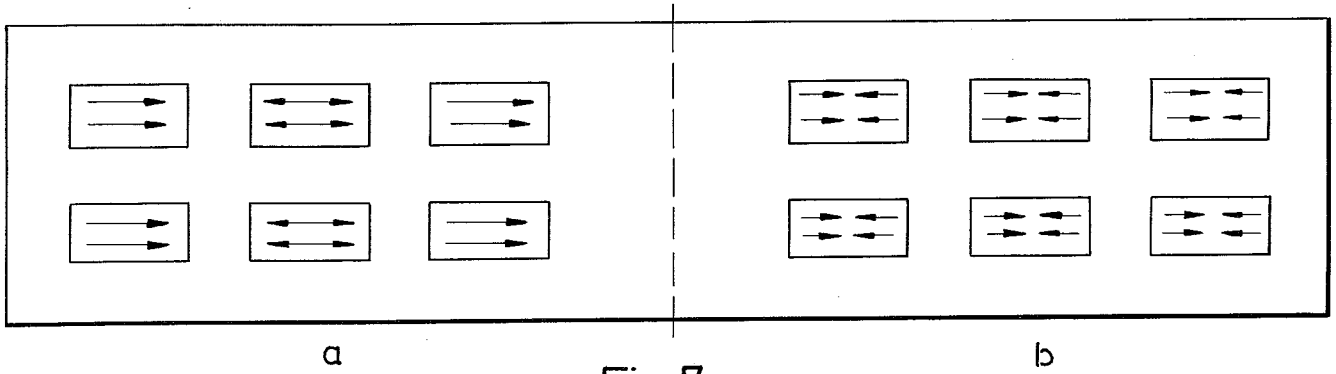

FIGS. 6 and 7 shows the commercially most important arrangements of the hoodlike cover with reference to anode groups *a*, *b* and *c* consisting of six anodes, which are right-angled. In accordance with FIG. 6 the ends of the anodes and in accordance with FIG. 7 the sides of the anodes extend in the longitudinal direction of the electrolytic cell. The arrows resulting indicate the direction of flow of the gas-electrolyte suspension.

EXAMPLE

An electrolytic cell having a flowing mercury cathode which had an area of 12 $m^2$ was provided with 84 graphite anodes having a thickness of 20 cm. On the surface which faced the mercury, the anodes were formed with groovelike recesses in a width of 5 mm and a depth of 16 cm. The reslting ribs had a width of 5 mm. The chlorine-brine suspension could escape through passage openings which were drilled into the bottoms of the groove-like recesses and had an inside width of 5 mm.

The electrolyte consisted of a common salt solution which contained 300 g/l NaCl and had a pH value of 7 and an inlet temperature of 60° C.

The electrolytic cell was used first in the form described herein before, without a hoodlike cover, and with a current density of 8, 5 $kA/m^2$ of the anode surface area. The average voltage, properties of the electrolyte, and temperature of the electrolyte were determined during a prolonged run.

The electrolytic cell was then altered by the incorporation of hoodlike covers. The cover consisted of hard polyvinylchloride and had the shape of a single-pitched roof having a inclination of 10°. The covers over adjacent anodes were upwardly inclined in opposite directions (as shown in FIG. 4).

In the table, the measured values recorded also during a prolonged run are compared with the measured values recorded during the first run.

| Measured value | Cell without cover | Cell with cover |
|---|---|---|
| Cell voltage | 4.47 volts | 4.15 volts |

-continued

| Measured value | Cell without cover | Cell with cover |
|---|---|---|
| Brine temperature at outlet | 70 - 75° C | 65 - 70° C |
| pH value of brine at outlet | 8 - 9 | 3 - 4 |
| $Cl_2 + CO_2$ contents of gas | 97 - 99% by volume | 98 - 99.5% by volume |
| $CO_2$ content of gas | 1.2% by volume | 0.8% by volume |
| $H_2$ content of gas | 0.6& by volume | 0.3% by volume |

From the comparison of the measured values it is apparent that the cell voltage of the electrolytic cell according to the invention was substantially lower, by 0.32 volt, than the cell voltage of the known cell. A comparison of the $CO_2$ contents of the gas shows particularly that the consumption of graphite was much decreased because the recirculation of the electrolyte was improved. The $H_2$ content of the gas and the pH value of the brine at the outlet of the cell furnish information regarding inherently undesired secondary reactions which take place in the electrolytic cell. The decomposition of amalgam resulting in the formation of hydrogen and sodium hydroxide solution (pH value) was much decreased. The slightly acid pH value is due to the formation of hypochlorous acid.

What is claimed is:

1. Electrolytic cell for carrying out processes during which gas is evolved, comprising at least one hoodlike cover means disposed above one or more electrode means having an outlet opening below the electrolyte surface for the gas-electrolyte suspension and an electrolyte-recycling space positioned outside the projection of the cover means, said recycling space being free from gas-producing electrodes and being spaced a sufficient distance from said outlet opening that the backflow of gas is precluded.

2. Electrolytic cell of claim 1 wherein the hoodlike cover means has a top which rises toward said outlet opening.

3. Electrolytic cell of claim 1 wherein substantially horizontal anode means are provided with flow passages and the hoodlike cover means closes at least one upper edge portion of the anode.

4. Electrolytic cell of claim 2 wherein the anode means form a structural unit with the hoodlike cover means.

5. Electrolytic cell of claim 2 wherein the anode means are provided on the underside with groovelike recesses of approximately constant depth.

6. Electrolytic cell of claim 5 wherein the top of the hoodlike cover means rises approximately at right angles to the groovelike recesses.

* * * * *